US010291979B2

(12) United States Patent
Horbach et al.

(10) Patent No.: US 10,291,979 B2
(45) Date of Patent: May 14, 2019

(54) HEADPHONE EAR CUSHION

(71) Applicant: Harman International Industries, Inc., Stamford, CT (US)

(72) Inventors: Ulrich Horbach, Canyon Country, CA (US); Kevin Bailey, Palmdale, CA (US)

(73) Assignee: Harman International Industries Incorporated, Stamford, CT (US)

( * ) Notice: Subject to any disclaimer, the term of this patent is extended or adjusted under 35 U.S.C. 154(b) by 102 days.

(21) Appl. No.: 15/508,537

(22) PCT Filed: Sep. 4, 2015

(86) PCT No.: PCT/US2015/048559

§ 371 (c)(1),
(2) Date: Mar. 3, 2017

(87) PCT Pub. No.: WO2016/037067

PCT Pub. Date: Mar. 10, 2016

(65) Prior Publication Data

US 2017/0366894 A1 Dec. 21, 2017

Related U.S. Application Data

(60) Provisional application No. 62/045,920, filed on Sep. 4, 2014.

(51) Int. Cl.

| | |
|---|---|
| ***H04R 25/00*** | (2006.01) |
| ***H04R 1/10*** | (2006.01) |
| ***H04R 5/033*** | (2006.01) |

(52) U.S. Cl.

CPC ..... *H04R 1/1083* (2013.01); *H04R 1/1008* (2013.01); *H04R 1/1075* (2013.01); *H04R 5/033* (2013.01)

(58) Field of Classification Search
CPC combination set(s) only.
See application file for complete search history.

(56) References Cited

U.S. PATENT DOCUMENTS 3,798,393 A 3/1974 Gorike
5,497,427 A * 3/1996 Nageno ..... H04R 1/1066 381/381

(Continued)

FOREIGN PATENT DOCUMENTS

| | | | |
|---|---|---|---|
| EP | 0589623 | A2 | 3/1994 |
| JP | 2010157974 | A | 7/2010 |
| KR | 1020110011671 | A | 2/2011 |

OTHER PUBLICATIONS

PCT International Search Report and Written Opinion dated Dec. 10, 2015 for PCT/US2015/048559.

*Primary Examiner* — Amir H Etesam
(74) *Attorney, Agent, or Firm* — Brooks Kushman P.C.

(57) ABSTRACT

A headphone is provided with a housing and a transducer. The housing has a baffle surface with a recess formed therein and an edge formed about a periphery of the baffle surface. The transducer disposed in the recess and supported by the housing. The headphone is also provided with an ear cushion and a sheet. The ear cushion has a base formed in an annular shape and connected to the housing about the edge and a contact surface spaced apart from the base to engage a portion of a user's head around an outer ear, wherein the ear cushion defines a cavity to collectively form an acoustic chamber with the user's head. The sheet is disposed over the baffle surface with a hole formed therethrough and aligned with the transducer. The sheet is also formed of a sound absorbent material to suppress sound reflections within the acoustic chamber.

17 Claims, 6 Drawing Sheets

(56) References Cited

U.S. PATENT DOCUMENTS

| | | | | |
|---|---|---|---|---|
| 6,775,390 | B1 * | 8/2004 | Schmidt | H04M 1/05 181/128 |
| 7,853,034 | B1 | 12/2010 | Gresko | |
| 8,447,058 | B1 | 5/2013 | Sung et al. | |
| 2007/0154049 | A1 | 7/2007 | Levitsky et al. | |
| 2010/0119076 | A1 * | 5/2010 | Monk | A61F 11/14 381/71.6 |
| 2010/0128884 | A1 | 5/2010 | Sapiejewski | |
| 2012/0140961 | A1 | 6/2012 | Reiss et al. | |

* cited by examiner

HEADPHONE EAR CUSHION

CROSS-REFERENCE TO RELATED APPLICATIONS

This application claims the benefit of U.S. provisional application Ser. No. 62/045,920 filed Sep. 4, 2014, the disclosure of which is hereby incorporated in its entirety by reference herein.

TECHNICAL FIELD

One or more embodiments relate to ear cushions for circum-aural headphones.

BACKGROUND

A circum-aural (around-the-ear) headphone includes an ear cushion for coupling the headphone transducer to the ear of a user, while providing an acoustic seal to form an acoustic pressure chamber with smooth and extended frequency responses within the audible band (i.e., between 20 Hz to 20 kHz). Sound reflections and modes in the chamber have an undesirable effect on perceived frequency response, particularly at high frequencies above 1 kHz. The design of the headphone transducer and the ear cushion affect the sound reflections.

SUMMARY

In one embodiment, a headphone is provided with a housing and a transducer. The housing has a baffle surface with a recess formed therein and an edge formed about a periphery of the baffle surface. The transducer disposed in the recess and supported by the housing. The headphone is also provided with an ear cushion and a sheet. The ear cushion has a base formed in an annular shape and connected to the housing about the edge and a contact surface spaced apart from the base to engage a portion of a user's head around an outer ear. The ear cushion defines a cavity and collectively forms an acoustic chamber with the user's head. The sheet is disposed over the baffle surface with a hole formed therethrough and aligned with the transducer. The sheet is formed of a sound absorbent material to suppress sound reflections within the acoustic chamber.

In another embodiment a headphone is provided with a housing having a baffle surface with a peripheral edge, an annular base that is connected to the housing about the peripheral edge and an inner wall that extends longitudinally from the base. The headphone is also provided with a contact surface and a cover. The contact surface extends transversely from the inner wall and is spaced apart from the base to engage a portion of a user's head around an outer ear to collectively form a cavity with the base and inner wall. The cover is disposed over the inner wall to suppress sound reflections.

In yet another embodiment an ear cushion is provided with an annular base and an inner wall and an outer wall that both extend longitudinally from the base. The ear cushion is also provided with a contact surface and a cover. The contact surface extends between the inner wall and the outer wall and is spaced apart from the base to engage a portion of a user's head around an outer ear. The cover is disposed over the inner wall and is formed of an acoustically transparent material to suppress sound reflections.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
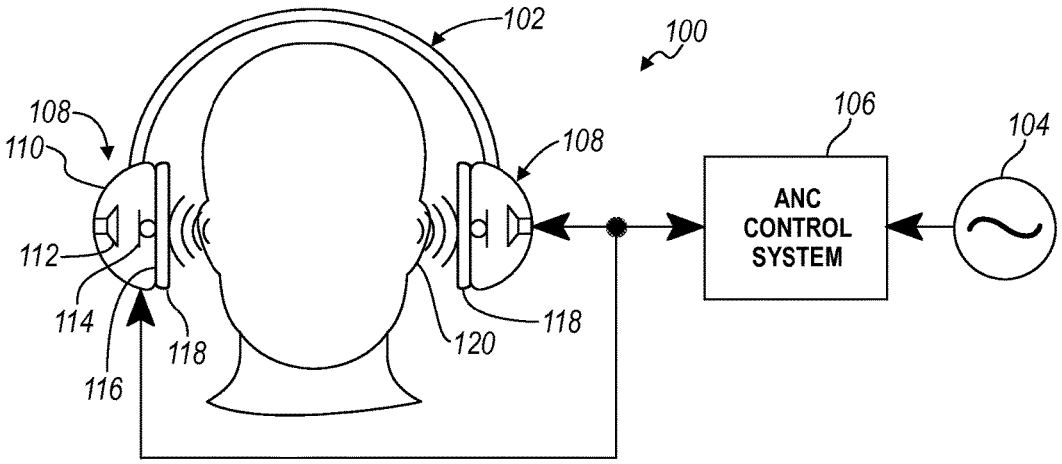
FIG. 1 is a schematic diagram illustrating a sound system including headphones having ear cushions, according to one or more embodiments.

With reference to FIG. 1, a sound system is illustrated in accordance with one or more embodiments and generally referenced by numeral 100. The sound system includes a headphone assembly 102 that receives an audio signal from an audio source 104. In one or more embodiments, the sound system 100 includes an active noise cancelling (ANC) control system 106 connected between the audio source 104 and the headphone assembly 102, such as the ANC control system described in International Patent Application No. PCT/US2014/053509 to Horbach et al. The headphone assembly 102 includes a pair of headphones 108.

Each headphone 108 includes a housing 110 that supports a transducer 112, or driver and at least one microphone 114. The housing 110 is formed in a cup shape, according to the illustrated embodiment. The housing 110 includes a baffle surface 116 with a recess 117 (shown in FIGS. 3 and 4) formed therein for receiving the transducer 112. The transducer 112 radiates sound away from the headphone 108.

Figure 2:
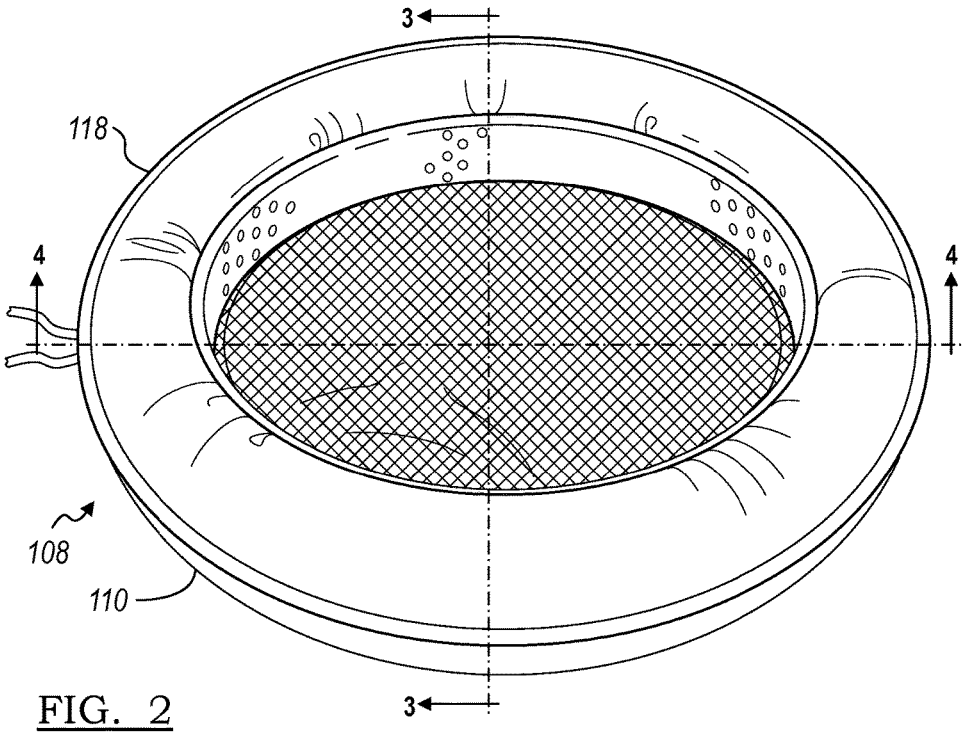
FIG. 2 is a side perspective view of a headphone of FIG. 1, according to another embodiment.
Figure 3:
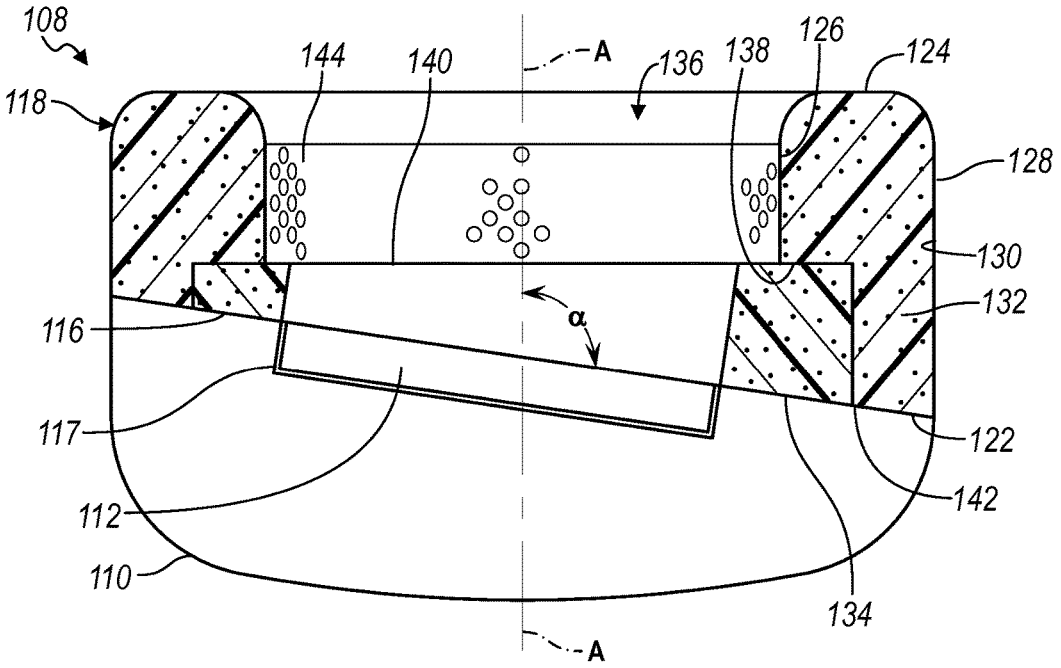
FIG. 3 is a horizontal section view of the headphone of FIG. 2, taken along section line 3-3.

Referring to FIGS. 2-3, each headphone 108 also includes an ear cushion 118 for contacting the user's head around the ear 120 to form an acoustic seal. The ear cushion 118 includes a base 122 that is formed in an annular shape and connected to a peripheral edge of the baffle surface 116 of the housing 110. The ear cushion 118 also includes a contact surface 124, an inner wall 126 and an outer wall 128. The contact surface 124 is spaced apart from the base 122 and engages a portion of a user's head around the ear 120 (shown in FIG. 1). The inner wall 126 and outer wall 128 extend between the base 122 and the contact surface 124. In one or more embodiments the base 122, contact surface 124, inner wall 126 and the outer wall 128 are formed as a unitary structure that is formed by a resilient material such as leather or protein leather and defines a cavity 130. The ear cushion 118 includes compliant material 132 that is disposed within the cavity 130. The compliant material is a polymeric material, such as memory foam, according to one or more embodiments. In one embodiment the compliant material 132 includes 45% polymers of propylene oxide and ethylene oxide, 40% toluene diisocyanate, 10% triethylenediamine, and 5% other materials. The ear cushion 118 provides a soft contact surface for engaging the head, an acoustic seal, and controls the frequency response and noise isolation within the whole audio band.

Each headphone includes a sheet 134 that is disposed over the baffle surface 116 for suppressing sound reflections within an acoustic chamber 136 defined by the baffle surface 116, ear cushion 118 and human head. A recess 138 is formed into a lower portion of the inner wall 126 of the ear cushion 118 that is sized for receiving a peripheral portion of the sheet 134. The sheet 134 includes an aperture 140 that is aligned with the transducer 112 to allow the transmission of sound. The sheet 134 is formed of a of sound absorbent foam material. In one embodiment, the sheet 134 is formed of foam containing approximately 65% polyether polyol, 30% toluene diisocyanate and 5% other materials. The material of the sheet is selected to effectively dampen acoustic waves at high frequencies (e.g., above 1-2 kHz). Additionally, the sheet 134 is formed of a material that has a lower density than that of the outer compliant material 132 selected for absorbing sound, according to one or more embodiments.

Each headphone includes a rigid material 142 that is disposed between the sheet 134 and the ear cushion 118 that follows the shape of the interface for securing the sheet 134 to the ear cushion 118.

The headphone 108 also includes a cover 144 that is formed of an acoustically transparent material. The cover 144 is attached to the inner wall 126 of the ear cushion 118. The cover 144 protects the ear cushion 118 from mechanical damage, and avoids any hard reflecting surface within the acoustic chamber 136.

Figure 4:
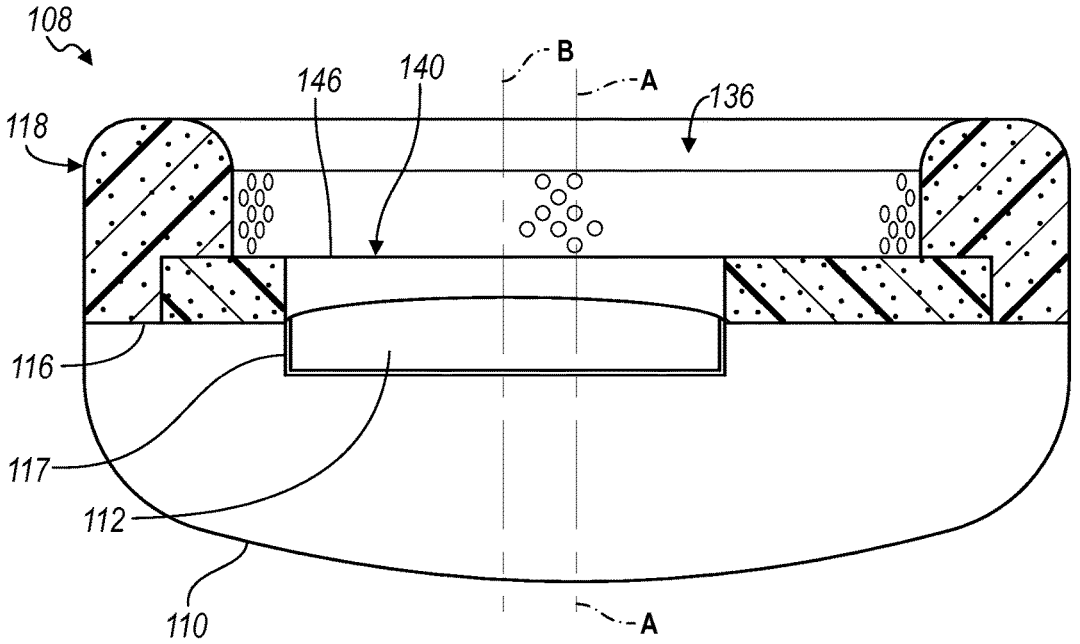
FIG. 4 is a vertical section view of the ear cushion of FIG. 2, taken along section line 4-4.

Referring to FIGS. 3 and 4, the housing 110 of the headphone 108 is formed in an elliptical shape about a central longitudinal axis (A) with a vertical length that is greater than a horizontal width, according to the illustrated embodiment. The transducer 112 and aperture 140 of the sheet 134 are oriented about an axis (B) that is offset from axis-A along the vertical length, as shown in FIG. 4. The concha (entrance of the ear canal) is not centered relative to the perimeter of the outer ear 120 (shown in FIG. 1). Accordingly, the transducer 112 and acentric aperture 140 are positioned so that the transducer 112 is centered at the concha.

The transducer 112 is asymmetrically mounted to further suppress reflections and modes in the acoustic chamber 136. The transducer 112 is mounted to the baffle surface 116, which is oriented at an angle (a) that is not perpendicular to axis-A (shown in FIG. 3). In the illustrated embodiment, the baffle surface 116 is formed at an angle (a) of seven degrees. The baffle surface 116 positions the transducer 112 parallel to or slightly forward of the user's ear (pinna). Also, introducing non-parallel surfaces to the design helps to further reduce unwanted reflections. The headphone 108 also includes a cloth 146 that is disposed over the sheet 134 to cover the aperture 140.

FIGS. 5-12 illustrate test samples and measurement results to compare the effectiveness of the ear cushion 118 with existing ear cushions (not shown).

Figure 5:
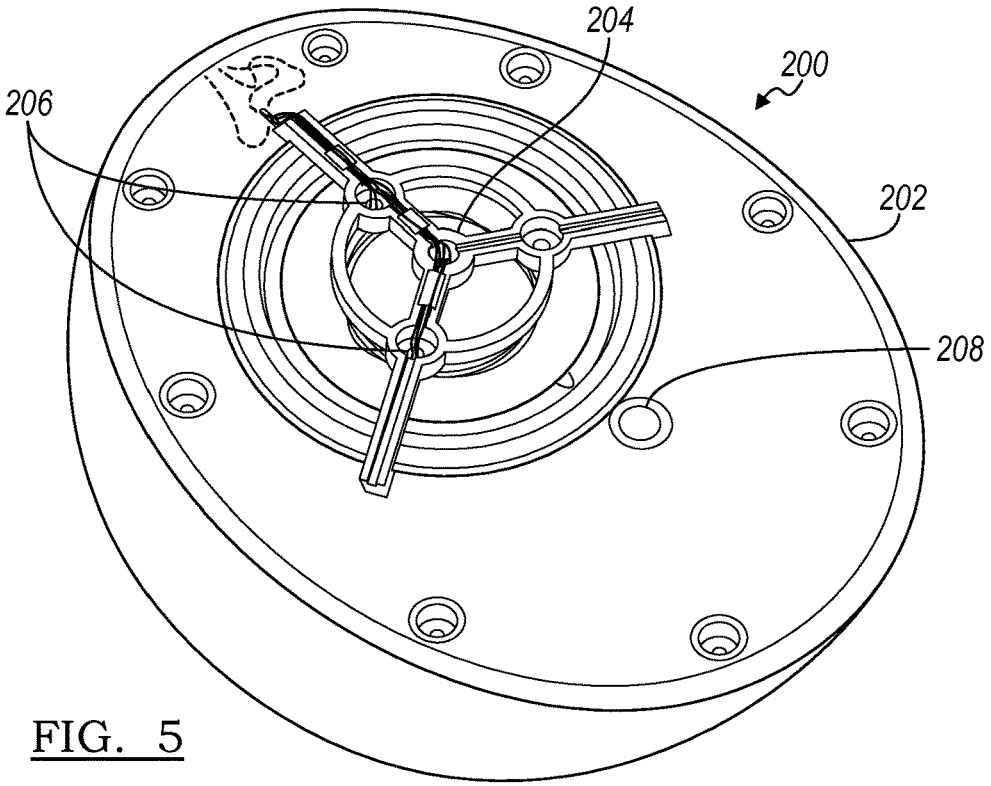
FIG. 5 is a side view of a test fixture representing one of the headphones of FIG. 1 without the ear cushion.

FIG. 5 illustrates a test fixture 200 that represents the headphone 108. The test fixture 200 includes an enclosure 202 that supports a transducer 204 and an array of microphones 206. The transducer 204 is a high-quality headphone driver with rigid (pistonic motion type) membrane. The enclosure 202 includes optimum rear volume and acoustic vents 208 (holes with acoustic resistance on baffle and rear enclosure). Further, the microphone array 206 is mounted directly above the transducer 204, capturing spatially averaged frequency responses.

Figure 6:
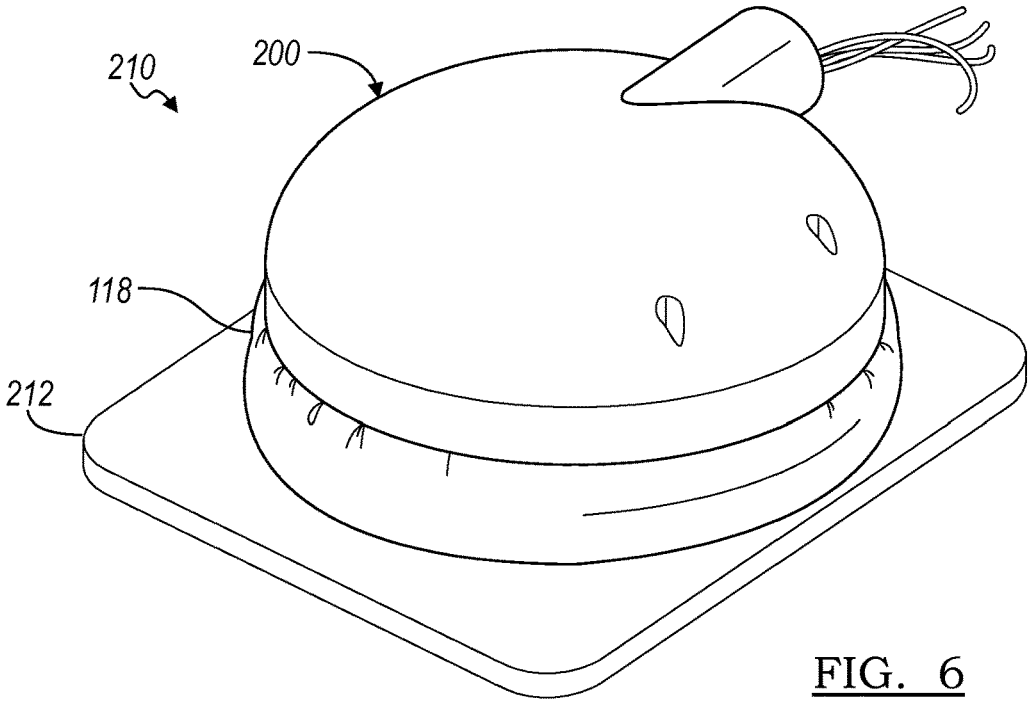
FIG. 6 is another side perspective view of the ear cushion of FIG. 2 mounted to the test fixture of FIG. 5 and disposed on a test plate.

FIG. 6 illustrates a test apparatus 210 including the test fixture 200 and a plate 212. The ear cushion 118 is mounted to the test fixture 200. The plate 212 includes built-in microphones (not shown) that can be used to measure the headphone's frequency response. The plate 212 terminates the ear cushion 118. Alternatively the ear cushion 118 can be terminated to a human head. Further details about this method are disclosed in U.S. patent application Ser. No. 14/319,936 to Horbach, entitled "Headphone Response Measurement and Equalization".

Figure 7:
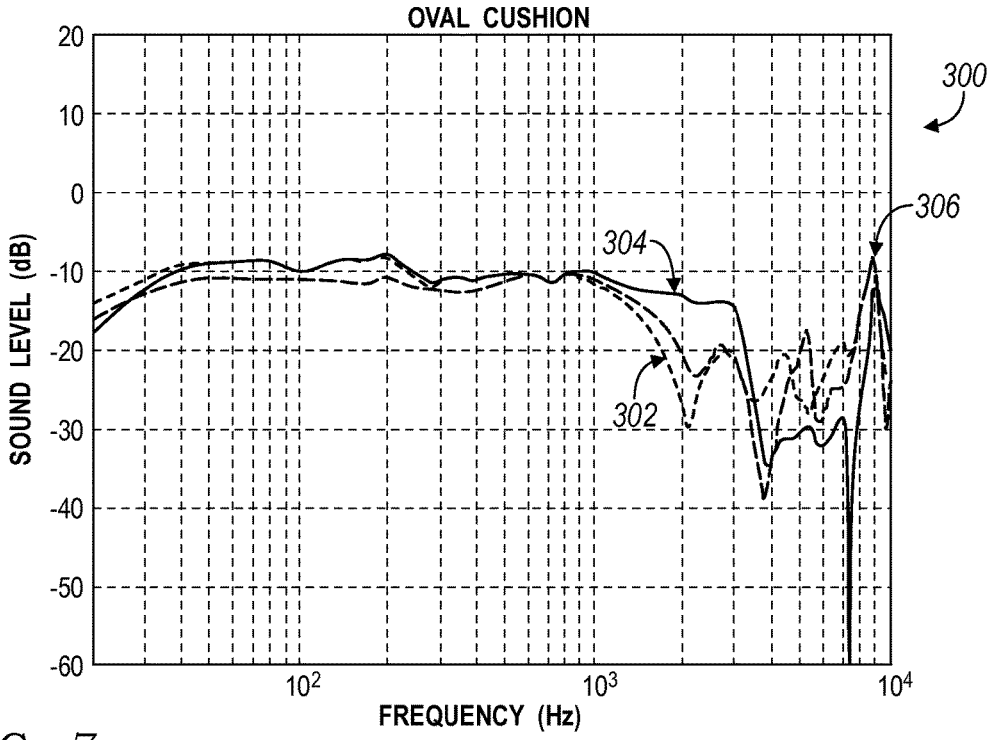
FIG. 7 is a graph illustrating the frequency response of an existing oval ear cushion, measured using the test fixture and test plate of FIG. 6.

FIG. 7 is a graph 300 illustrating three frequency response curves of an existing oval-shaped ear cushion (not shown) using the test apparatus 210 (shown in FIG. 6). The graph 300 includes a first curve 302 illustrating test data captured by the microphone array 206 of the test fixture 200, while the ear cushion is terminated to the plate 212; a second curve 304 illustrating test data captured by the microphones of the measurement plate 212 while the ear cushion is terminated to the plate 212; and a third curve 306 illustrating test data captured by the microphone array 206, while the ear cushion is terminated to a human head (normal use of a headphone).

The curves illustrated in FIG. 7 illustrate an acoustic low pass filter effect of the existing oval-shaped ear cushion, caused by the enclosed volume, with steep cutoffs of 10-20 dB and varying cutoff frequencies of 1.5-3 kHz, depending on the termination of the ear cushion and the measurement microphone location. The curves also indicate that a very uneven response occurs above the cutoff frequency, with steep notches that are difficult to equalize. Such a frequency response is accompanied by an impulse response spreading in time domain (smearing). Both problems will likely have a negative effect on perceived sound quality, even after equalization.

Figure 8:
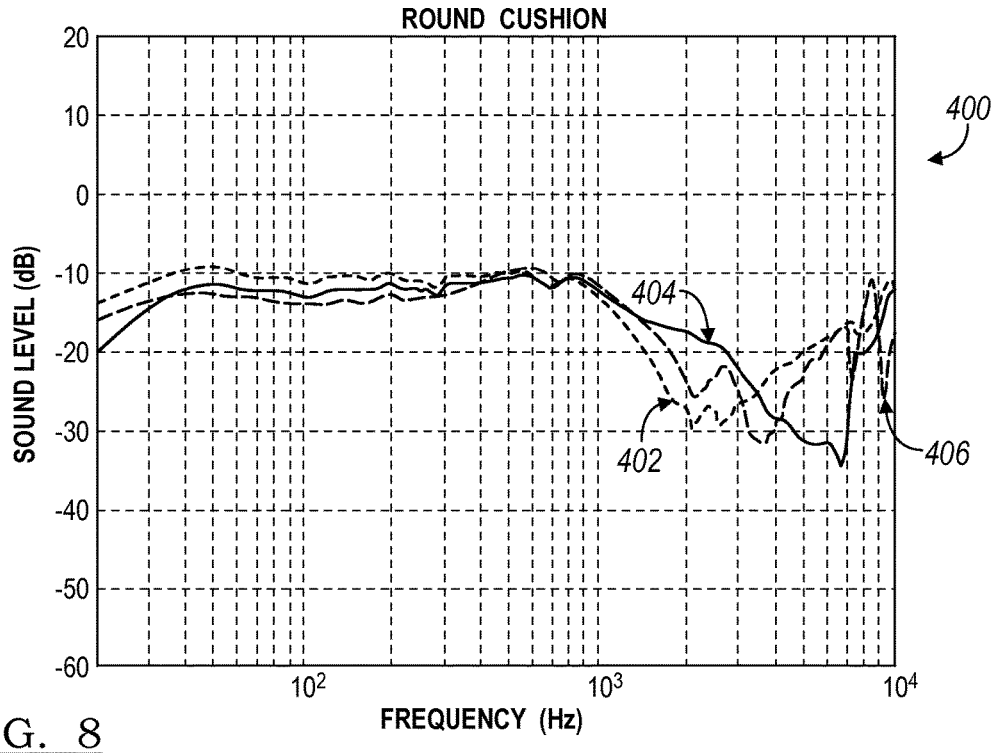
FIG. 8 is a graph illustrating the frequency response of an existing round ear cushion, measured using the test fixture and test plate of FIG. 6.

FIG. 8 is a graph 400 illustrating three frequency response curves of an existing round ear cushion (not shown) using the test apparatus 210 (shown in FIG. 6). The graph 400 includes a first curve 402 illustrating test data captured by the microphone array 206 of the test fixture 200, while the ear cushion is terminated to the plate 212; a second curve 404 illustrating test data captured by the microphones of the measurement plate 212, while the ear cushion is terminated to the plate 212; and a third curve 406 illustrating test data captured by the microphone array 206, while the ear cushion is terminated to a human head. The effects are equally dramatic as those shown in graph 300. The measurement plate 212 sees a drop of more than 20 dB in the interval from 1-7 kHz, before the response rises back to the normal level.

Figure 9:
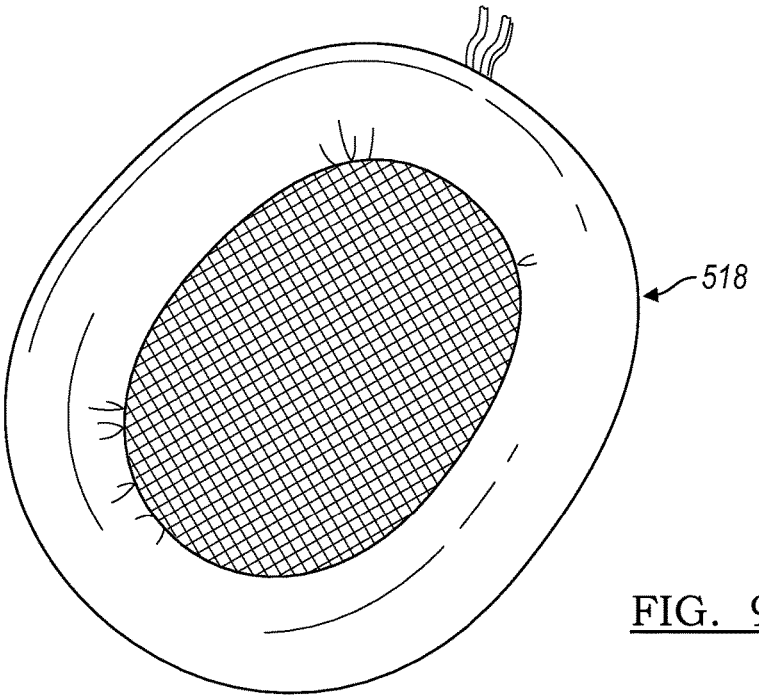
FIG. 9 is a side view of the ear cushion of FIG. 1 according to another embodiment.

With reference to FIG. 9, an ear cushion is illustrated in accordance with one or more embodiments and generally referenced by numeral 518. The ear cushion 518 is similar to the ear cushion 118 described above with reference to FIGS. 2-4 and it includes a sheet (not shown) that extends over a baffle surface (not shown). However, the ear cushion 518 does not include an acoustically transparent cover disposed over an inner wall of the ear cushion 518.

Figure 10:
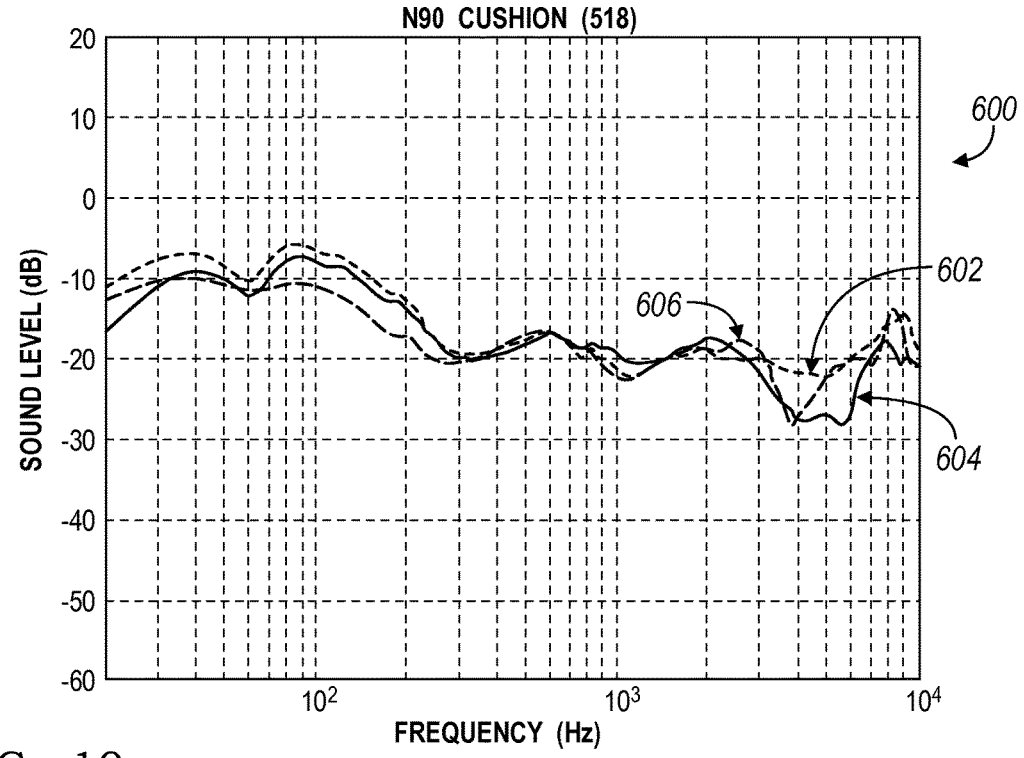
FIG. 10 is a graph illustrating the frequency response of the ear cushion of FIG. 9, measured using the test fixture and test plate of FIG. 6.
Figure 11:
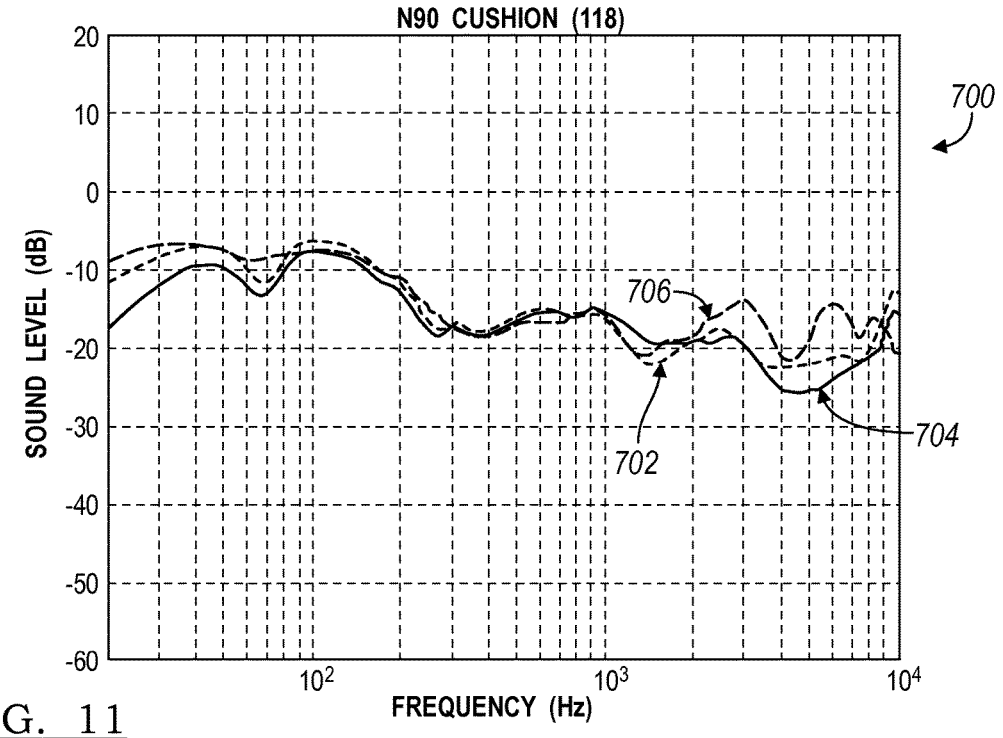
FIG. 11 is a graph illustrating the frequency response of the ear cushion of FIG. 2, measured using the test fixture and test plate of FIG. 6.
Figure 12:
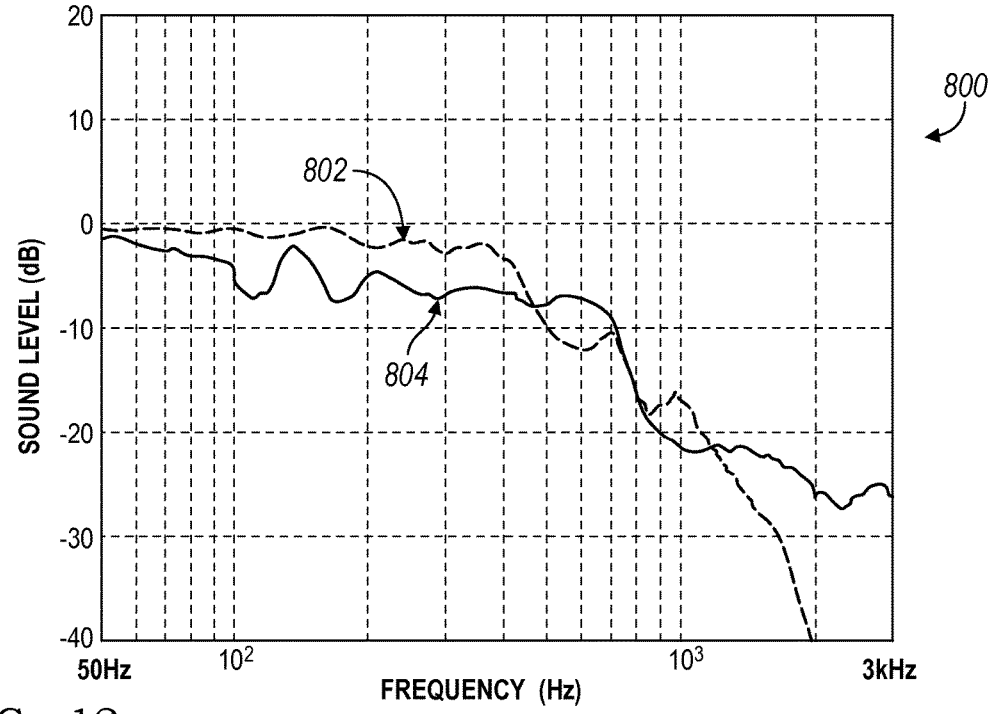
FIG. 12 is a graph illustrating the passive noise attenuation of the ear cushion of FIG. 2, measured using the test fixture and test plate of FIG. 6.

FIGS. 10-12 show results obtained from ear cushions in accordance with one or more embodiments of the ear cushion of FIG. 1 (i.e. ear cushion 118 and ear cushion 518) which illustrate improvements of the ear cushion 118, 518 over existing ear cushions (as shown in graphs 300 and 400). The high-frequency issues almost completely disappear. The overall frequency responses are smooth and extended above 1 kHz, without the low pass effect, and much improved consistency between the three methods of capturing. The step between (100-200) Hz can be handled by equalization, while approximating a prescribed target function.

FIG. 10 is a graph 600 illustrating three frequency response curves of the ear cushion 518 (shown in FIG. 9) using the test apparatus 210 (shown in FIG. 6). The graph 600 includes a first curve 602 illustrating test data captured by the microphone array 206 of the test fixture 200, while the ear cushion 518 is terminated to the plate 212; a second curve 604 illustrating test data captured by microphones of the measurement plate 212, while the ear cushion 518 is terminated to the plate 212; and a third curve 606 illustrating test data captured by the microphone array 206, while the ear cushion 518 is terminated to a human head.

In particular, FIG. 11 includes a graph 700 illustrating three frequency response curves of the ear cushion 118 using the test apparatus 210 (shown in FIG. 6). The ear cushion 118 differs from ear cushion 518 in that it includes the acoustically transparent cover 144 that is attached to the inner wall 126 (shown in FIGS. 2-4). The graph 700 includes a first curve 702 illustrating test data captured by the microphone array 206 of the test fixture 200, while the ear cushion 118 is terminated to the plate 212; a second curve 704 illustrating test data captured by microphones of the measurement plate 212, while the ear cushion 118 is terminated to the plate 212; and a third curve 706 illustrating test data captured by the microphone array 206, while the ear cushion 118 is terminated to a human head.

The graph 700 shows a very close match of frequency responses at the two microphone positions, while the ear cushion 118 is terminated by the plate using the microphone array (first curve 702), and using the plate microphones (second curve 704). This enables an accurate prediction of the perceived response of the headphone when it's worn, by the built-in array microphones. The perceived response illustrated in the third curve 706 can be equalized for each person individually. In noise canceling applications, the same array may be used to provide acoustic error feedback. Stability and bandwidth of the feedback loop are enhanced due to the absence of a steep high frequency roll-off and its associated phase shift.

FIG. 12 is a graph 800 that illustrates a comparison of the passive noise reduction capability of the ear cushion 118 (FIGS. 2-4) based on different compliant material. The graph 800 includes a first curve 802 illustrating test data from an external noise source, captured by the plate microphones 206, while the ear cushion 118 is terminated to the plate 212, and includes compliant material formed of hard memory foam; and a second curve 804 illustrating test data captured as above, while the ear cushion 118 is terminated to the plate 212, and includes compliant material formed of selected soft foam. The graph 800 illustrates that more than 20 dB attenuation may be reached at 1 kHz, which is highly desirable for high-quality noise canceling headphones. Depending on the foam material chosen, passive noise attenuation may start at frequencies as low as 100 Hz.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A headphone comprising:

a housing with a baffle surface with a recess formed therein and an edge formed about a periphery of the baffle surface;

a transducer disposed in the recess and supported by the housing;

an ear cushion with a base formed in an annular shape and connected to the housing about the edge and a contact surface spaced apart from the base to engage a portion of a user's head around an outer ear, wherein the ear cushion defines a cavity and collectively forms an acoustic chamber with the user's head, and wherein the baffle surface is oriented non-parallel to the contact surface to position the transducer generally parallel to a user's ear to reduce sound reflections within the acoustic chamber; and a sheet disposed over the baffle surface with a hole formed therethrough and aligned with the transducer, the sheet formed of a sound absorbent material to suppress sound reflections within the acoustic chamber, wherein the sheet is formed with a non-uniform thickness with an outer surface that is oriented generally parallel to the contact surface of the ear cushion.

2. The headphone of claim 1 wherein the ear cushion further comprises:

an inner wall and an outer wall that extend between the base and the contact surface to collectively form the cavity with the base and the contact surface; and a cover disposed over the inner wall to further suppress sound reflections within the acoustic chamber.

3. The headphone of claim 2 wherein the inner wall is formed of a resilient material and the cover is formed of an acoustically transparent material that is different from the resilient material.

4. The headphone of claim 1 wherein the sheet is formed of a foam material.

5. The headphone of claim 1, wherein a hardness of compliant material disposed in the cavity of the ear cushion is less than a hardness of the sheet.

6. The headphone of claim 1 wherein a central axis of the recess of the housing is offset from a central longitudinal axis of the housing.

7. The headphone of claim 6 wherein the baffle surface is oriented at an angle that is not perpendicular to the central longitudinal axis of the housing.

8. A headphone comprising:

a housing having a baffle surface with a recess formed therein and a peripheral edge;

a transducer disposed in the recess and supported by the housing; an annular base connected to the housing about the peripheral edge;

an inner wall extending longitudinally from the annular base;

a contact surface extending transversely from the inner wall and spaced apart from the annular base to engage a portion of a user's head around an outer ear, and to collectively form a cavity with the annular base and inner wall, wherein the baffle surface is oriented non-parallel to the contact surface to position the transducer generally parallel to a user's ear to reduce sound reflections;

a sheet disposed over the baffle surface with a hole formed through and aligned with the transducer, the sheet formed of a sound absorbent material to suppress sound reflections, wherein the sheet is formed with a non-uniform thickness with an outer surface that is oriented generally parallel to the contact surface; and a cover disposed over the inner wall to suppress sound reflections.

9. The headphone of claim 8 wherein the cover is formed of an acoustically transparent material.

10. The headphone of claim 8 wherein the sheet is formed of foam material comprising polyether polyol and toluene diisocyanate.

11. The headphone of claim 8 further comprising compliant material disposed in the cavity, and wherein a hardness of the compliant material is less than a hardness of the sheet.

12. The headphone of claim 8 wherein a central axis of the recess of the housing is offset from a central longitudinal axis of the housing.

13. The headphone of claim 8 wherein the baffle surface is oriented at an angle that is not perpendicular to a central longitudinal axis of the housing.

14. A headphone comprising:

a housing having a baffle surface with a recess formed therein and an edge formed about a periphery of the baffle surface;

a transducer disposed in the recess and supported by the housing; and an ear cushion comprising:

an annular base connected to the housing about the edge;

an inner wall and an outer wall extending longitudinally from the annular base;

a contact surface extending between the inner wall and the outer wall and spaced apart from the annular base to engage a portion of a user's head around an outer ear, wherein the annular base, the inner wall and the contact surface are formed as a unitary structure, wherein the baffle surface is oriented non-parallel to the contact surface to position the transducer generally parallel to a user's ear to reduce sound reflections; and a cover attached to and disposed over the inner wall and formed of an acoustically transparent material to suppress sound reflections; and a sheet disposed over the baffle surface with a hole formed through and aligned with the transducer, the sheet formed of a sound absorbent material to suppress sound reflections, wherein the sheet is formed with a non-uniform thickness with an outer surface that is oriented generally parallel to the contact surface.

15. The headphone of claim 14 wherein a central axis of the recess of the housing is offset from a central longitudinal axis of the housing.

16. The headphone of claim 14 wherein the baffle surface is oriented at an angle that is not perpendicular to a central longitudinal axis of the housing.

17. The headphone of claim 14 wherein the ear cushion defines a cavity and wherein the headphone further comprises compliant material disposed in the cavity, and wherein a hardness of the compliant material is less than a hardness of the sheet.

* * * * *